United States Patent [19]

Lamb

[11] Patent Number: 4,466,143

[45] Date of Patent: Aug. 21, 1984

[54] SWIMMING POOL COVER LEADING EDGE WHEEL ASSEMBLY

[76] Inventor: Joe H. Lamb, 117 W. Fireclay Ave., Murray, Utah 84107

[21] Appl. No.: 470,989

[22] Filed: Mar. 1, 1983

[51] Int. Cl.[3] ..... E04H 3/19

[52] U.S. Cl. ..... 4/502; 4/498; 4/503; 4/504

[58] Field of Search ..... 4/502, 503, 504, 498, 4/500

[56] References Cited

U.S. PATENT DOCUMENTS

| | | | |
|---|---|---|---|
| 3,050,743 | 8/1962 | Lamb | 4/502 |
| 3,273,171 | 9/1966 | Lamb | 4/502 |
| 3,277,498 | 10/1966 | Kleinbard et al. | 4/502 |
| 3,747,132 | 7/1973 | Foster | 4/502 |
| 3,982,286 | 9/1976 | Foster | 4/502 |
| 4,001,900 | 1/1977 | Lamb | 4/502 |
| 4,195,370 | 4/1980 | Budd | 4/502 |
| 4,407,027 | 10/1983 | Colon, Jr. | 4/502 |

*Primary Examiner*—Henry K. Artis

*Attorney, Agent, or Firm*—Workman, Nydegger & Jensen

[57] ABSTRACT

A wheel assembly for use with extendible and retractable swimming pool covers having a raised leading edge. The apparatus of the present invention preferably comprises two rigid arms which each have a wheel attached to one end thereof. The other end of the arms are rotatably connected to an expandable plug which is adapted to fit into one end of the horizontal leading edge carrier member of the pool cover. A bolt passes through a washer, through an axial bore in the expandable plug, and through holes in the ends of both arms so as to connect all of the component parts together. A wing nut is then tightened onto the end of the bolt, thereby causing the expandable plug to expand within the leading edge carrier member. The wheel assembly is thus secured to the end of the carrier member, with the arms being prevented from further rotation after installation.

10 Claims, 5 Drawing Figures

SWIMMING POOL COVER LEADING EDGE WHEEL ASSEMBLY

BACKGROUND

1. The Field of the Invention

The present invention relates to swimming pool covers having a raised leading edge. More particularly, the present invention is directed to wheel assembly apparatus and methods for supporting the raised leading edge of a mechanically extendible swimming pool cover during pool cover extension and retraction.

2. The Prior Art

For a number of reasons, it is advantageous and increasingly common to provide swimming pools with a swimming pool cover. For example, a cover substantially reduces pool maintenance time and cost by helping to keep dirt, leaves, and other debris from getting into the pool. A swimming pool cover also decreases the need for chemical treatment, and it can further help to minimize the energy which is required to heat the pool. Additionally, the use of a swimming pool cover when the pool is not in use greatly reduces the risk that an unattended child will enter the pool and drown.

Of course, one way to cover a swimming pool is to manually extend a large cover sheet across the pool and to secure the edges of the cover sheet to the pool deck. However, such a procedure is usually quite time consuming, and, additionally, more than one individual may be required in order to cover the pool properly. Therefore, in order to increase the convenience of using a pool cover, and in order to make the frequent use of a pool cover more practicable, many swimming pool owners make use of a pool cover which is mechanically extended and retracted across the swimming pool by an electric motor.

One type of pool cover which is well adapted to such mechanical extension and retraction comprises a large, rectangular cover sheet having thickened, or beaded, side edges. The beaded edges of the cover sheet are slidably received in open channels formed in respective, parallel tracks which are positioned adjacent to opposite sides of the swimming pool. Typically, there is sufficient slack in the cover sheet such that a portion of the cover sheet rests on the surface of the water after it is fully extended across the pool, with the beaded side edges being continuously maintained in and laterally secured by the respective channels.

In order to minimize the likelihood that the pool cover's leading edge will dip into the water during extension, thereby causing water to flow onto the top of the cover sheet, mechanically extendible swimming pool covers are usually provided with a rigid leading edge. Optionally, the cover sheet may also have a central gore or a screen formed therein adjacent the leading edge of the pool cover, in order to allow for the drainage of any water which might collect on the cover sheet.

When the swimming pool cover is not in use, the cover sheet is rolled upon an elongated cylindrical member, which is located at one end of the pool. In order to cover the pool, the electric motor draws the edges of the cover sheet along the respective tracks so as to extend the cover sheet from one end of the swimming pool to the other. When the pool is to be again uncovered, the motor rolls the cover sheet back onto the cylindrical member; the cover sheet is thus retracted and stored for future use.

When a pool cover of the type described above is installed on a substantially rectangular swimming pool at the same time as such pool is being constructed, the side tracks are generally mounted inside the pool just below the pool deck. Thus, when the beaded edges of the cover sheet are properly positioned in their respective channels, the cover extends across the pool from one inside edge to the other. In such a case, the above-described pool cover may be used without modification, and it can also be mechanically extended and retracted without difficulty.

Matters are quite different, however, when a mechanically extendible pool cover is to be installed on an existing rectangular swimming pool or on any pool which has a non-rectangular shape. In such cases, it is generally preferable to install a rectangular pool cover outside of the pool such that the parallel side tracks are secured to the top of the pool deck adjacent to the pool edges. Installing the pool cover in this manner both eliminates the need to remove a portion of the pool deck and pool sides on existing pools and avoids the operational difficulties caused by attempting to mechanically extend and retract an odd-shaped swimming pool cover.

However, several difficulties arise when the pool cover is so installed outside of the pool. These difficulties are primarily due to the fact that a portion of the pool deck will necessarily underlie the pool cover after the cover is fully extended over the swimming pool, particularly in the case of odd-shaped pools. Thus, when a pool cover is installed outside of the pool, the cover will tend to drag across the pool deck's surface as it is extended and retracted, thereby making cover extension and retraction more difficult. Additionally, the rigid leading edge of the pool cover may similarly drag across the surface of the deck, thus causing undue wear both to the pool deck and to the rigid leading edge of the pool cover. Moreover, the rigid leading edge, which generally tends to sag slightly in the middle, may sometimes be unable to clear the odd-shaped or the endmost portions of the pool deck.

In order to overcome these difficulties, those skilled in the art have employed systems to raise the leading edge of the pool cover above the parallel side tracks. By raising the leading edge, one can significantly reduce the frictional forces which resist pool cover extension and retraction. Further, raising the leading edge of the pool cover eliminates the possibility that the leading edge will drag across the pool deck, thereby insuring that the leading edge will clear all portions of the deck.

However, when raising the leading edge of the pool cover, it is desirable to raise the leading edge by only the amount necessary to achieve the desired benefits. It will be appreciated, for example, that when a leading edge of the pool cover is raised by more than the necessary amount, dirt tends to get into the pool under the leading edge, thereby nullifying some of the benefits of a swimming pool cover. Additionally, if the leading edge is raised more than necessary, the pool cover's appearance is generally less desirable, and the pool cover becomes more of an obstruction.

The exact height to which the leading edge must be raised varies from pool to pool and is determined by the particular characteristics of the specific swimming pool being covered. For example, when a swimming pool is substantially rectangular, the side tracks may be secured quite close to the pool edges, which are usually at about the same height as one another. Therefore, when a pool cover of the type described above is installed on an existing rectangular pool, it is typically necessary to raise the leading edge only slightly in order to achieve the desired benefits.

This is not the case, however, when such a cover is installed on an odd-shaped pool. Since the swimming pool cover sheet is rectangular, it follows that the side tracks must necessarily be laid down in substantially parallel, straight lines, regardless of the shape of the pool. Thus, when an odd-shaped pool is to be covered, some sections of the tracks may be positioned several feet away from the pool, while other track sections would be very close to the pool edge. Since the pool deck typically slopes away from the pool in order to provide for proper drainage (this slope being generally about one downward inch for every four lateral feet), the distant sections of the tracks may be several inches lower than the portions of the pool deck which are near the edges of the swimming pool. Consequently, in order to insure proper pool cover operation on odd-shaped pools, it is sometimes necessary to raise the leading edge of the pool cover six or more inches above the two side tracks.

Since it is, therefore, nearly impossible to determine the exact height to which the leading edge of the pool cover must be raised prior to the time that the pool cover is actually being installed, it is generally preferable to use adjustable wheel assemblies to suspend the leading edge of the pool cover so that the leading edge suspension height may be varied during pool cover installation. The use of adjustable wheel assemblies thus permits the leading edge of the pool cover to be suspended at exactly the appropriate height, and it eliminates the need to separately manufacture wheel assemblies for each pool cover or to manufacture a number of different sizes of leading edge wheel assemblies.

One common type of an adjustable leading edge wheel assembly for mechanically extendible swimming pool covers is disclosed in U.S. Pat. Nos. 3,273,171 and 4,001,900. As illustrated in FIGS. 4 and 5, this prior art wheel assembly, designated generally as 58, comprises a pair of offset axles 60, each having a wheel 62 connected to one end thereof. The other ends of axles 60 are individually journaled in a bearing block 68; cotter pins 70, or other suitable means, secure axles 60 in bearing block 68 (see FIG. 5). As shown in FIG. 4, a length of substantially nonstretchable material, such as a link chain 66, serves to maintain the axles 60 in a mutually spread condition.

As illustrated, bearing block 68 is constructed so as to conform to the generally tubular inner surface of the leading edge carrier member 50. Thus, an assembled prior art wheel assembly 58 may be connected to carrier member 50 by first inserting the assembly's bearing block 68 into one open end of carrier member 50 as shown, and thereafter securing block 68 within carrier member 50 by means of a screw 64 or some other suitable securing means. The height to which the leading edge of the pool cover is raised by these prior art wheel assemblies can then be adjusted by varying the spread of the two axles 60. For example, as illustrated in FIG. 4, a hook 67 may be attached to one axle 60 and used to secure chain 66 at the appropriate place so as to maintain the desired axle spread.

Although the adjustable wheel assemblies of the prior art described above have proven generally adequate to raise a leading edge of the pool cover to the desired height, there are several problems associated with their use. First, these wheel assemblies are somewhat difficult and time consuming to manufacture. Each of the axle rods must be precisely bent to the proper offset shape. Such bending of the axle rods is difficult and may often not be done with enough precision to insure that the wheels will be properly aligned. Holes must also be drilled in one end of the axle rods to receive the cotter pins; and a chain, a hook, and wheels must be separately attached to the completed axles.

Equally important, it is quite time consuming to assemble and install the prior art wheel assemblies. Prior to assembly, a bearing block must first be drilled to receive the two axles. The offset axles are then inserted into the bearing blocks, with cotter pins being thereafter inserted through the holes in the axle rods. The completed wheel assembly's bearing block must then be placed into one end of the leading edge of the pool cover carrier member and secured therein by means of a screw. Significantly, this latter step typically requires drilling through the leading edge carrier member at the installation site.

Moreover, the prior art wheel assemblies also have a number of operational difficulties. For example, in order to make the wheel assemblies adjustable, an oversized chain is typically used. Consequently, when the wheel assembly is raised to near its maximum height, the chain tends to drag across the surface of the pool deck, thereby causing increased noise, wear on the pool deck, and possible interference with the rotation of the wheels. Although the excess chain may be removed, this would render it impossible to further adjust the height of the leading edge, if such adjustment should ever be needed. Additionally, since it is difficult to precisely bend the axle rods, the two wheels are often not properly aligned with one another. Thus, the wheels may tend to drag or slide across the pool deck as the pool cover is extended and retracted.

Accordingly, it would be an improvement in the art to provide a swimming pool cover leading edge wheel assembly which can be manufactured, assembled, and installed with a minimum number of steps and component parts. It would also be an improvement in the art to provide a leading edge wheel assembly which does not require the precision bending of axle rods and does not require the drilling of axle rods. Additionally, it would be an improvement in the art to provide an adjustable leading edge wheel assembly which operates smoothly, dependably, and without interference from a dragging chain or other component parts. It would be a still further improvement in the art to provide a method for suspending the leading edge of a swimming pool cover which obviates the need for a complex manufacturing process but which provides a means for adjusting the height of the leading edge, without sacrificing smooth and dependable pool cover operation. Such apparatus and methods are disclosed and claimed herein.

BRIEF SUMMARY AND OBJECTS OF THE INVENTION

The present invention is directed to an adjustable wheel assembly which can be economically manufactured and which can be quickly assembled and connected to the leading edge of a swimming pool cover. The leading edge wheel assembly of the present invention comprises two, substantially flat, rigid arms. Each arm has a wheel mounted on one end, and the other end of each arm is adjacent an expandable plug. A bolt passes through both the expandable plug and the adjacent ends of the two arms, and a wing nut is screwed onto the threaded end of the bolt, thereby rotatably securing the arms to the expandable plug. Importantly, the expandable plug is adapted to fit snugly into one of the open ends of the leading edge carrier member of the pool cover.

When connecting the wheel assembly of the present invention to a leading edge of the pool cover, the expandable plug is first inserted into one of the ends of the tubular leading edge carrier member. The arms are then oriented so as to suspend both the leading edge and its carrier member at the appropriate height. Thereafter, the wing nut is tightened so as to cause the expandable plug to expand; thus, the plug is secured within the carrier member, and further rotation of the two rigid arms is prevented.

It is, therefore, a primary object of the present invention to provide an improved, adjustable means for suspending the leading edge of a swimming pool cover.

It is another object of the present invention to provide a swimming pool cover leading edge wheel assembly which is easy to manufacture and which does not require the precision bending of axle rods.

It is also an object of the present invention to provide a swimming pool cover leading edge wheel assembly which has a minimum number of component parts and which is easy to assemble and install.

It is a further object of the present invention to provide a leading edge wheel assembly for a swimming pool cover which may be continuously adjusted to various heights without the use of a chain or other component part that may drag across the pool deck surface or otherwise interfere with the smooth operation of the assembly.

It is a still further object of the present invention to provide a method for suspending the leading edge of a swimming pool cover which is simple, economical, and dependable.

These and other objects and features of the present invention will become more fully apparent from the following description and appended claims taken in conjunction with the accompanying drawings.

DETAILED DESCRIPTION OF THE PREFERRED EMBODIMENTS

Figure 2:
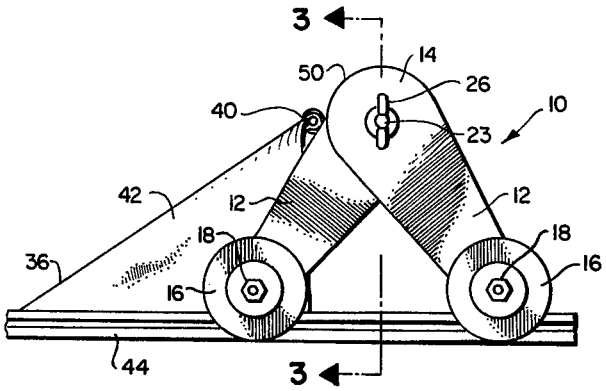
FIG. 2 is an end elevational view of one preferred embodiment of the leading edge wheel assembly of the present invention taken along lines 2—2 of FIG. 1.
Figure 3:
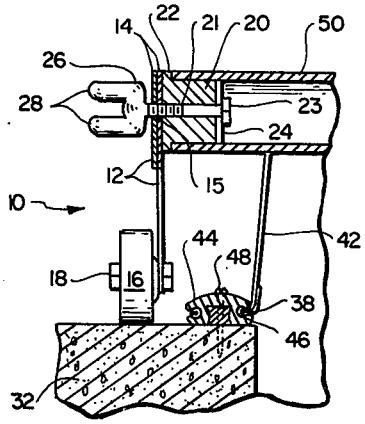
FIG. 3 is a cross-sectional view of the leading edge wheel assembly of the present invention taken along lines 3—3 of FIG. 2.
Figure 4:
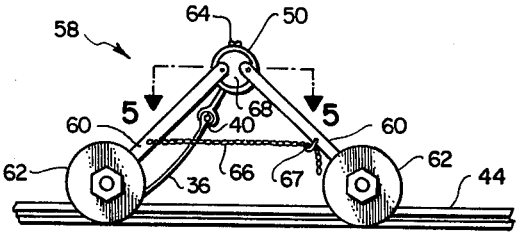
Fig. 4 (PRIOR ART)
FIG. 4 is an end elevational view of a typical prior art leading edge wheel assembly which utilizes a chain and two separate offset axles to adjust the height of the leading edge of the pool cover.
Figure 5:
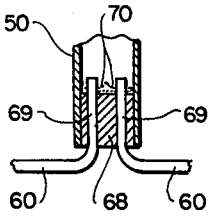
Fig. 5 (PRIOR ART)
FIG. 5 is a top cross-sectional view of a prior art leading edge wheel assembly taken along lines 5—5 of FIG. 4.

Reference is now made to the figures wherein like parts are designated with like numerals throughout. It will be readily appreciated that the components of the present invention, as generally described and illustrated in the figures herein, could be arranged and designed in a wide variety of different configurations. Thus, the following, more detailed description of the embodiment of the apparatus and method of the present invention, as depicted in FIGS. 1-3, is merely representative of one presently preferred embodiment of the invention.

The leading edge wheel assembly of the present invention, designated generally as 10, is particularly adapted for use with a mechanically extendible swimming pool cover. In FIG. 1, a typical, mechanically extendible swimming pool cover 34, which includes two such leading edge wheel assemblies 10, is illustrated.

Swimming pool cover 34 comprises a flexible cover sheet 36 and two parallel side tracks 44; tracks 44 are secured on opposite sides of a swimming pool 30. As best shown in FIG. 3, each side edge 38 of cover sheet 36 is provided with a thickened portion or bead which is slidably received into an open channel 46 in the respective track 44. Thus, during both extension and retraction of cover sheet 36, the cover sheet's beaded side edges 38 are continuously maintained in and laterally secured by tracks 44.

Figure 1:
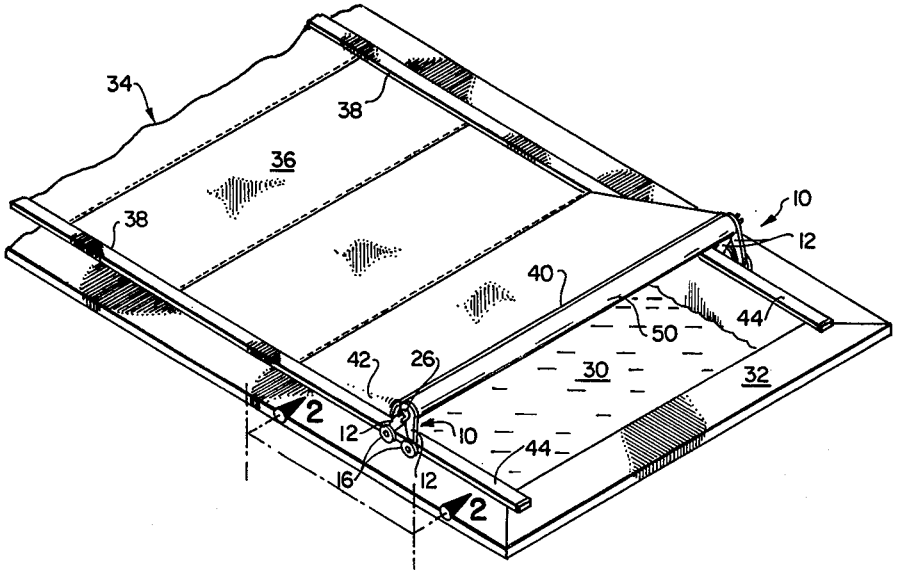
FIG. 1 is a partial perspective view of an installed and partially extended swimming pool cover which comprises one presently preferred embodiment of the leading edge wheel assembly of the present invention.

As shown in FIG. 1, the leading edge 40 of cover 36 is connected to a horizontal carrier member 50. As illustrated, horizontal carrier member 50 is generally cylindrical in shape and extends across swimming pool 30 so as to be substantially perpendicular to tracks 44. A leading edge wheel assembly 10 is attached to each end of horizontal carrier member 50, such that both carrier member 50 and leading edge 40 are supported in a raised position. Advantageously, in order to permit leading edge 40 to be appropriately raised, cover sheet 36 may be provided with side gores 42 adjacent leading edge 40.

When swimming pool cover 34 is constructed as described above, it may be mechanically extended and retracted over swimming pool 30 by means which are known in the art. Importantly, leading edge wheel assemblies 10 maintain horizontal carrier member 50, together with leading edge 40, in a sufficiently raised position to insure clearance of all portions of the swimming pool deck 32 during such pool cover extension and retraction.

The specific construction of one presently preferred embodiment of leading edge wheel assembly 10 is illustrated more particularly in FIGS. 2 and 3. With particular reference to FIG. 2, leading edge wheel assembly 10 comprises two substantially flat, rigid arms 12. Arms 12 may be formed from any suitable material. For example, in one presently preferred embodiment, arms 12 are formed of aluminum. One end 14 of each arm 12 is preferably rounded so as to have substantially the same curvature as the ends of the cylindrical, horizontal carrier member 50. As shown best in FIG. 3, wheels 16 are attached to the other end of each arm 12 by means of a suitable axle assembly 18 such that wheels 16 may rotatably engage pool deck 32 when arms 12 are in a substantially vertical position.

As further depicted in FIG. 3, the rounded ends 14 of arms 12 are rotatably connected to an expandable plug 20. While expandable plug 20 may have any suitable configuration, expandable plug 20 is illustrated as being substantially cylindrical in shape and of a size that permits it to fit snugly into one of the open ends of horizontal carrier member 50. Expandable plug 20 may also include an annular lip 22 adjacent one end thereof, in order to prevent expandable plug 20 from being pushed completely inside of carrier member 50.

In one presently preferred embodiment, expandable plug 20 is formed entirely of an elastomeric material, such as, for example, rubber. However, expandable plug 20 may be formed in any suitable manner. For example, expandable plug 20 may be formed of substantially rigid material and be made to expand mechanically.

Expandable plug 20 has an axial bore 21 therethrough. In addition, the rounded ends 14 of arms 12 each have a hole 15 therein. Importantly, holes 15 of arms 12 should align with axial bore 21 of the expandable plug when the rounded ends 14 of the arms are placed against the outward end of the expandable plug.

With holes 15 and axial bore 21 so aligned, a bolt 23, having a washer 24 thereon, is inserted through expandable plug 20 and arms 12 so as to extend outwardly from arms 12. As illustrated, washer 24 has an outside diameter which is just slightly less than the inside diameter of carrier member 50; thus, when bolt 23 is fully inserted, washer 24 rests against the inward end of expandable plug 20. Advantageously, in order to prevent bolt 23 from rotating with respect to washer 24, bolt 23 and washer 24 may be welded together. Alternatively, bolt 23 and washer 24 may fit together in carriage fit relationship.

A wing nut 26 is threaded onto the outward end of bolt 23, thereby securing arms 12 to expandable plug 20. Preferably, wings 28 of the wing nut are also elongated, as shown, in order to allow a screw driver to be inserted between wings 28 to facilitate tightening of the wing nut.

Leading edge wheel assembly 10 may be economically manufactured in a number of ways and from a number of suitable materials. Importantly, since both arms 12 of leading edge wheel assembly 10 are identical, leading edge wheel assembly 10 may be manufactured using a minimal number of different component parts. In one presently preferred embodiment of leading edge wheel assembly 10, for example, numerous arms 12 are punched out of a large sheet of aluminum and are each thereafter provided with the appropriate axle 18 and wheel 16. Two such assembled arms 12 are then connected to an expandable plug 20, as described previously.

Furthermore, arms 12 may have any length which is suitable for the intended application. For example, in one preferred embodiment, arms 12 are eight inches long. Significantly, since such arms 12 will permit the pool cover's leading edge 40 (see FIG. 1) to be raised by as much as six inches, such arms 12 are suitable for use on nearly all rectangular pools and on a large number of odd-shaped pools. However, when it is necessary to raise the leading edge 40 of pool cover 34 by more than about six inches, arms 12 may need to be somewhat longer than eight inches in order to provide the required stability to leading edge wheel assembly 10.

After leading edge wheel assembly 10 is assembled as described above, it may be quickly installed on a swimming pool cover 34 at the installation site. During installation, expandable plug 20 is first inserted into one end of horizontal carrier member 50, as illustrated in FIG. 3. The orientation of arms 12 is then adjusted so as to support carrier member 50 at the appropriate height, and wing nut 26 is thereafter tightened. The tightening of wing nut 26 causes expandable plug 20 to expand, thereby securing expandable plug 20 within the end of carrier member 50. The tightened wing nut 26 also secures arms 12 to the outward end of expandable plug 20 and prevents arms 12 from being rotated from the previously set orientation. Optionally, a rubber washer may be placed between the two arms 12 in order to further prevent any rotation of arms 12 after installation.

From the above discussion, it will be appreciated that the present invention provides an improved, adjustable means for suspending the leading edge of a swimming pool cover. Since the apparatus of the present invention has a minimal number of different component parts, none of which must be separately drilled, the leading edge wheel assembly of the present invention is easy to manufacture and assemble. Significantly, since the apparatus does not include offset axles, there is no need for the precision bending of axle rods. Additionally, as described above, the leading edge wheel assembly of the present invention may be quickly and easily installed and continuously adjusted to various heights without the use of a chain or other member which may drag across the pool deck surface. Thus, it will be appreciated that the present invention has provided a method for suspending the leading edge of a swimming pool cover which is simple, economical, and dependable.

The invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A leading edge wheel apparatus for use on a swimming pool cover having a raised leading edge, said leading edge being supported by an open-ended horizontal member which extends across a swimming pool, the apparatus comprising:

an expandable plug located within an open end of the horizontal member, said plug being configured such that, when expanded, the plug is securely positioned within the open end of the horizontal member, at least one rigid arm, each arm having two ends;

a wheel rotatably connected to a first end of each rigid arm so as to be capable of rolling along a substantially horizontal surface; and means for securing a second end of each arm to the expandable plug, said securing means both causing the expandable plug to expand and preventing movement of the arms with respect to the plug.

2. A leading edge wheel apparatus as defined in claim 1 wherein there are two rigid arms.

3. A leading edge wheel apparatus as defined in claim 1 wherein said rigid arms lie substantially in a vertical plane.

4. A leading edge wheel apparatus as defined in claim 1 wherein said rigid arms are substantially flat.

5. A leading edge wheel apparatus as defined in claim 1 wherein the expandable plug has a bore therethrough and the second end of each rigid arm has a hole therein, and wherein the securing means comprises:

a bolt which passes through both the bore of the expandable plug and the hole in each rigid arm; and a nut screwed onto an end of the bolt so as to securely engage the expandable plug and each rigid arm.

6. A leading edge wheel apparatus as defined in claim 5 further comprising a washer on the bolt adjacent an end of the bolt engaging the expandable plug.

7. A leading edge wheel apparatus as defined in claim 5 wherein said nut is a wing nut having elongated wings so as to permit the nut to be tightened by means of a lever inserted between said wings.

8. A leading edge wheel apparatus as defined in claim 1 wherein said expandable plug includes a raised lip which prevents the expandable plug from being inserted completely inside of the horizontal member.

9. A leading edge suspension apparatus for a leading edge of an extendible and retractable swimming pool cover, the apparatus comprising:

a rigid, open-ended, substantially cylindrical, horizontal member extending across a swimming pool, said horizontal member being connected to the leading edge of the swimming pool cover;

two substantially cylindrical, expandable plugs having an axial bore therethrough, each such plug being located within an open end of said horizontal member, each such plug being configured such that, when expanded, the plug is securely positioned within the open end of the horizontal member;

four, substantially flat, rigid arms, each having two ends, with a first end of each arm having a hole therein;

four wheels, each wheel being rotatably connected adjacent a second end of one of the arms, said wheels being capable of rolling along a substantially horizontal surface when the arms lie substantially in a vertical plane;

two bolts, each bolt passing through the axial bore of one of the plugs and also through the holes in two of the arms, and each bolt extending outwardly from the adjacent end of the horizontal member;

two washers, each washer being on one of the bolts so as to reside against an inward side of the respective expandable plug; and two wing nuts, each wing nut being screwed onto an outward end of one of the bolts, said wing nuts having elongated wings so as to permit the nuts to be tightened by means of a lever inserted between said wings, the tightening of the wing nuts causing the expandable plugs to expand and both preventing movement of the arms with respect to the plugs and maintaining a predetermined angle between each pair of arms.

10. A mechanically extendible and retractable swimming pool cover having a raised leading edge, comprising:

a substantially rectangular, flexible sheet of material having a leading edge, two lateral edges, and a rearward edge, the lateral edges of the flexible sheet being beaded;

two substantially parallel track members secured on opposite sides of a swimming pool, each track member having a first open channel formed therein which slidably receives the beaded lateral edges of the flexible sheet;

a rigid, open-ended, substantially cylindrical, horizontal member extending across the swimming pool between said track members so as to be substantially perpendicular thereto, said horizontal member being connected to the leading edge of the flexible sheet;

two substantially cylindrical, expandable plugs having an axial bore therethrough, each such plug being located within an open end of said horizontal member, each such plug being configured such that, when expanded, the plug is securely positioned within the open end of the horizontal member;

four, substantially flat, rigid arms, each having two ends, with a first end of each arm having a hole therein;

four wheels, each wheel being rotatably connected adjacent a second end of one of the arms, said wheels being capable of rolling along a substantially horizontal surface when the arms lie substantially in a vertical plane;

two bolts, each bolt passing through the axial bore of one of the plugs and also through the holes in two of the arms, and each bolt extending outwardly from the adjacent end of the horizontal member;

two washers, each washer being on one of the bolts so as to reside against an inward side of the respective expandable plug;

two wing nuts, each wing nut being screwed onto an outward end of one of the bolts, said wing nuts having elongated wings so as to permit the nuts to be tightened by means of a lever inserted between said wings, the tightening of the wing nuts causing the expandable plugs to expand and both preventing movement of the arms with respect to the plugs and maintaining a predetermined angle between each pair of arms; and means for extending and retracting the flexible sheet over the swimming pool.

* * * * *